US007767891B2

(12) United States Patent
Yamaguchi

(10) Patent No.: US 7,767,891 B2
(45) Date of Patent: Aug. 3, 2010

(54) KEY FOR KEYBOARD-BASED MUSICAL INSTRUMENTS

(75) Inventor: Tsutomu Yamaguchi, Hamamatsu (JP)

(73) Assignee: Kabushiki Kaisha Kawai Gakki Seisakusho, Shizuoka-ken (JP)

( * ) Notice: Subject to any disclaimer, the term of this patent is extended or adjusted under 35 U.S.C. 154(b) by 0 days.

(21) Appl. No.: 10/591,494

(22) PCT Filed: Feb. 17, 2005

(86) PCT No.: PCT/JP2005/002480

§ 371 (c)(1),
(2), (4) Date: Sep. 1, 2006

(87) PCT Pub. No.: WO2005/083673

PCT Pub. Date: Sep. 9, 2005

(65) Prior Publication Data

US 2007/0137461 A1 Jun. 21, 2007

(30) Foreign Application Priority Data

Mar. 2, 2004 (JP) ..... 2004-057892

(51) Int. Cl.
*G10C 3/12* (2006.01)

(52) U.S. Cl. ..... 84/423 R; 84/433; 521/54

(58) Field of Classification Search ..... 84/423 R, 84/433; 521/54
See application file for complete search history.

(56) References Cited

U.S. PATENT DOCUMENTS

| | | | | |
|---|---|---|---|---|
| 4,394,457 | A * | 7/1983 | Ogasa | 521/54 |
| 5,559,297 | A * | 9/1996 | Yoshikawa et al. | 84/433 |
| 2006/0251694 | A1 * | 11/2006 | Nielsen et al. | 424/422 |

FOREIGN PATENT DOCUMENTS

| | | | |
|---|---|---|---|
| JP | 62-158757 | | 7/1987 |
| JP | 62158757 | A * | 7/1987 |
| JP | 63-237096 | | 10/1988 |
| JP | 3-287198 | | 12/1991 |
| JP | 07-044156 | | 2/1995 |

* cited by examiner

*Primary Examiner*—Jianchun Qin
(74) *Attorney, Agent, or Firm*—Crowell & Moring LLP

(57) ABSTRACT

A key for keyboard-based musical instrument is provided for ensuring high hydrophilia and thereby ensuring higher playing performance. A key 1 for an electronic piano 2 comprises a key body 10 made of an ABS resin, and a thin plate-shaped key touch member 11 adhered on the top surface of the key body 10. The key touch member 11 comprises a base 11*b* made of an ABS resin, and a hydrophilic polymer 11*a* added in the base 11*b* in a dispersed manner. While a player is playing a keyboard-based musical instrument, sweat at the tip of his/her finger is absorbed by the hydrophilic polymer 11*a*.

4 Claims, 2 Drawing Sheets

KEY FOR KEYBOARD-BASED MUSICAL INSTRUMENTS

TECHNICAL FIELD

The present invention relates to a key for keyboard-based musical instruments which allows a finger tip to touch the key with less susceptibility to slippage and therefore provides high playing performance while it is made of a synthetic resin.

BACKGROUND ART

Conventionally, a key for keyboard-based musical instruments is known, for example, from Patent Document 1. This key is made of an acrylate resin which does not contain a hydroxyl group, and a large number of porous particles are added therein in a dispersed manner. These porous particles are made of hydroxyapatite or the like, part of which exposes to the surface of the key. While a player is playing a keyboard-based musical instrument, sweat at the tip of his/her finger is physically captured and absorbed by pores in the porous particles, and as a result, the finger tip is less susceptible to slippage to ensure high playing performance, as compared with a key made only of an acrylate resin.

[Patent Document 1] Laid-open Japanese Patent Application No. 3-287198

DISCLOSURE OF THE INVENTION

According to the conventional key for keyboard-based musical instruments, its water absorption power is fairly low as compared with a key which has natural ivory adhered on a touched surface thereof because sweat at the tip of the player's finger is physically captured and absorbed by pores of porous particles such as hydroxyapatite or the like. Specifically, a key having natural ivory adhered thereto has a water absorption of approximately a dozen to 20 wt %, whereas the conventional key has a water absorption of as low as 1.5 wt % (data on a first table of Patent Document 1). Thus, the conventional key has a problem of low playing performance due to high susceptibility of a finger to slippage, as compared with the key having natural ivory adhered thereto.

The present invention has been made to solve the foregoing problem, and it is an object of the invention to provide a key for keyboard-based musical instruments which is capable of ensuring higher hydrophilia, and thereby ensuring higher playing performance.

To achieve the above object, a key for a keyboard-based musical instrument according to claim 1 is characterized by comprising a key body; and a key touch member disposed on the top of the key body, made of a first synthetic resin having a hydrophilic polymer added thereto, and for touching the key.

Generally, the hydrophilic polymer is known to provide higher water absorption power, as compared with porous particles which physically capture and absorb moisture with pores, because the hydrophilic polymer captures and absorbs moisture with a hydrophilic group thereof. Therefore, according to this key for a keyboard-based musical instrument, since the key touch member is made of the first synthetic resin with the hydrophilic polymer added thereto, the key can ensure higher hydrophilia and can thereby ensure higher playing performance, as compared with a conventional key made of an acrylate resin to which porous particles are added.

The invention according to claim 2 is characterized in that the first synthetic resin is one of an acrylonitrile butadyenne styrene resin, an acrylonitrile-styrene resin, and an acrylic resin in the key for a keyboard-based musical instrument according to claim 1.

According to this key for a keyboard-based musical instrument, since the key touch member is made of one of an acrylonitrile butadyenne styrene resin, an acrylonitrile-styrene resin, and an acrylic resin, the key can ensure high durability and workability, as well as can ensure an appearance which resembles a key to which natural ivory is adhered. As a result, a high commercial value can be ensured.

The invention according to claim 3 is characterized in that the key body is made of one of a second synthetic resin without the hydrophilic polymer added thereto, and a wood material, and the key touch member is adhered to the key body in the key for a keyboard-based musical instrument according to claim 1 or 2.

According to this key for a keyboard-based musical instrument, since the key touch member can be fabricated as a part separate from the key body, a reduced amount of hydrophilic polymer can be added, as compared with an entire key fabricated by integral molding of one type of synthetic resin. Also, when the entire key is made of the first synthetic resin with the hydrophilic polymer added thereto, its dimensions expand or contract due to a water absorbing state of the hydrophilic polymer to make it difficult to ensure the dimensional accuracy after the processing, possibly resulting in a lower quality such as noise. In contrast, according to the key of the present invention, since the key touch member alone need be made of the first synthetic resin with the hydrophilic polymer added thereto, the dimensional accuracy for the processed key body, i.e., the dimensional accuracy of the entire key can be ensured at a level substantially equal to that which is presented when the entire key is made of an ABS resin without the hydrophilic polymer added thereto, thus making it possible to avoid a lower quality. Further, when the key body may be made of a wood material, the key can be applied to an acoustic piano.

The invention according to claim 4 is characterized in that the key body is made of one of the first synthetic resin having the hydrophilic polymer added thereto and a second synthetic resin without the hydrophilic polymer added thereto, and is integrally molded with the key touch member in the key for a keyboard-based musical instrument according to claim 1 or 2.

According to this key for a keyboard-based musical instrument, since the key body and key touch member are integrally molded, the number of manufacturing steps can be reduced as compared with the key touch member and key body which are fabricated as separate parts, so that a time required to fabricate the key can be correspondingly reduced Also, when the key body is made of the second synthetic resin without the hydrophilic polymer added thereto, the dimensional accuracy for the processed key body, i.e., the dimensional accuracy of the entire key can be ensured at a level substantially equal to that which is presented when the entire key is made of a synthetic resin without the hydrophilic polymer added thereto, as compared with the entire key made only of the first synthetic resin with the hydrophilic polymer added thereto, for the reason set forth above, thus making it possible to avoid a lower quality.

A cross-sectional view illustrating a key according to one embodiment of the present invention and the configuration of a keyboard for an electronic piano to which the key is applied.

[FIG. 2]

An exploded perspective view illustrating a key touch member and a key body of a white key.

[FIG. 3]

A cross-sectional view illustrating the configuration of a white key.

BEST MODE FOR CARRYING OUT THE INVENTION

Figure 1:
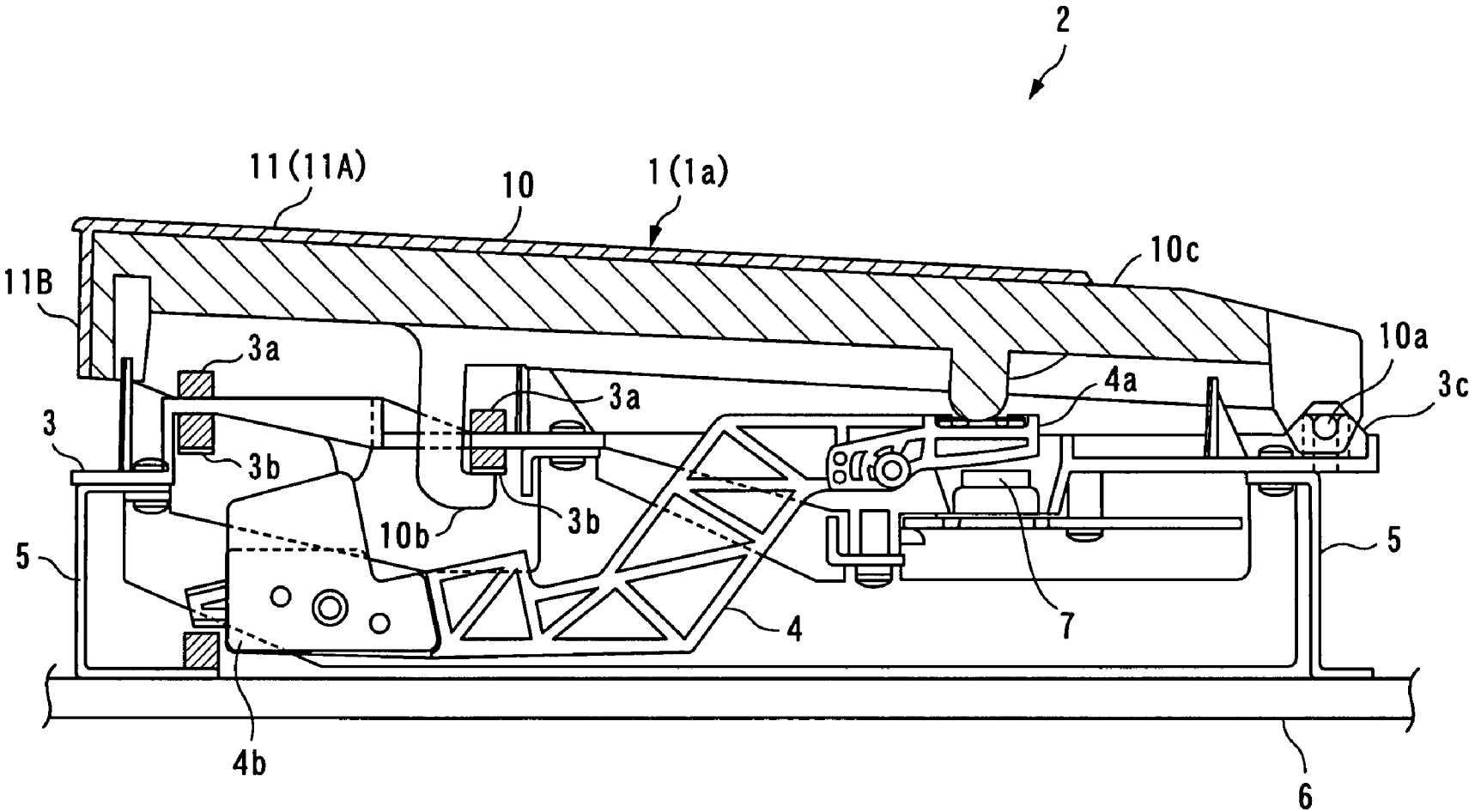
[FIG. 1]

In the following, a key for keyboard-based musical instruments according to one embodiment of the present invention will be described with reference to the drawings. As illustrated in FIG. 1, the key of this embodiment is applied to an electronic piano 2 as a keyboard-based musical instrument. The electronic piano 2 comprises, in a keyboard thereof, a chassis 3, a large number of keys 1 (one white key 1*a* alone is shown in the figure) comprised of white keys 1*a* and black keys (not shown) pivotably supported by the chassis 3, and a large number of hammers 4 (only one of which is shown in the figure) each provided for one key 1 and pivotably supported by the chassis 3.

The chassis 3 is fixed on a key bed 6 through a front and a rear coupling member 5, 5 and the like, and has two lower limit stoppers 3*a*, 3*a* mounted on the top surface in a front end area thereof with a spacing defined therebetween in a front-to-rear direction. Each lower limit stopper 3*a* is intended to restrict downward pivotal movements of the key 1, and is made of felt. Also, two upper limit stoppers 3*b*, 3*b* are mounted on the bottom surface of the chassis 3 in a front end area thereof at positions corresponding to the lower limit stoppers 3*a*, 3*a*. These lower limit stoppers 3*a*, 3*a* are intended to restrict upward pivotal movements of the key 1 and hammer 4, respectively, and is made of felt. Further, a key switch 7 is mounted in an area close to the rear end of the chassis 3 for each key 1.

The hammer 4 has its area close to the rear end pivotably supported by the chassis 3, a pressing member 4*a* on the rear end opposes the key switch 7 from above, and the hammer 4 has a weight 4*b* at the front end. The hammer 4 is urged by the weight 4*b* in the counter-clockwise direction in the figure, whereby the pressing member 4*a* is held at all times in contact with an actuator 10*c* of the key body 10, later described, in a key released state (state illustrated in FIG. 1).

Figure 2:
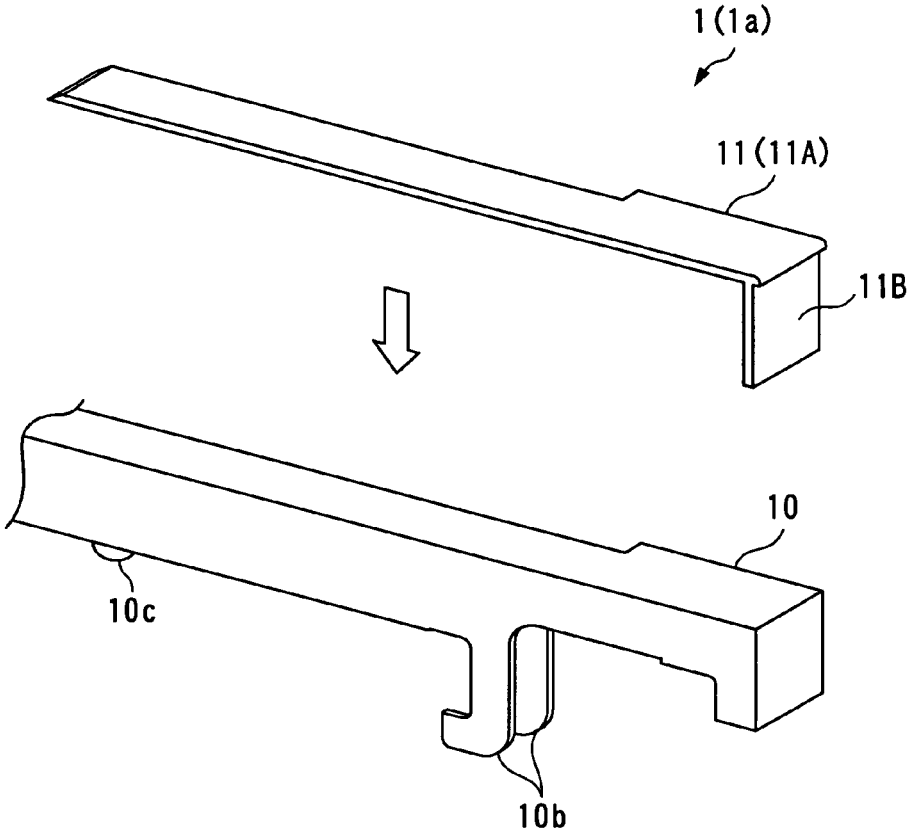

Since the white key 1*a* and black key are substantially similar in configuration in the keys of this embodiment, the following description will be made on the white key 1*a*, given as an example. As illustrated in FIGS. 1, 2, the white key 1*a* comprises the key body 10, and a key touch member 11 mounted on the top surface of the key body 10. The key body 10 is implemented by a molding of an acrylonitrile butadyenne styrene resin (ABS resin), which is a second synthetic resin, extends in the front-to-rear direction, and is provided with a pivot shaft 10*a*. This pivot shaft 10*a* extends in a left-to-right direction (depth direction in the figure), and is pivotably mounted to a bearing 3*c* of the chassis 3, whereby the key body 10 is pivotably supported by the chassis 3.

The key body 10 is also provided with L-shaped stoppers 10*b*, 10*b*, and the actuator 10*c*. As described above, the pressing member 4*a* of the hammer 4 is in contact with the actuator 10*c* from below in the key released state, whereby the stopper 10*b* is held in contact with the upper limit stopper 3*b*. On the other hand, when the white key 1*a* is touched, it pivotally moves in the counter-clockwise direction about the pivot shaft 10*a* to a position at which the white key 1*a* comes into contact with the lower stopper 3*a*, and the actuator 10*c* pushes the pressing member 4*a* below. Associated with this, the hammer 4 pivotally moves in the clockwise direction, and the pressing member 4*a* pushes down the key switch 7 to cause an on-operation. As a result, the key switch 7 outputs an on-signal to a sound generator circuit (not shown) for performing a sound generating operation.

Figure 3:
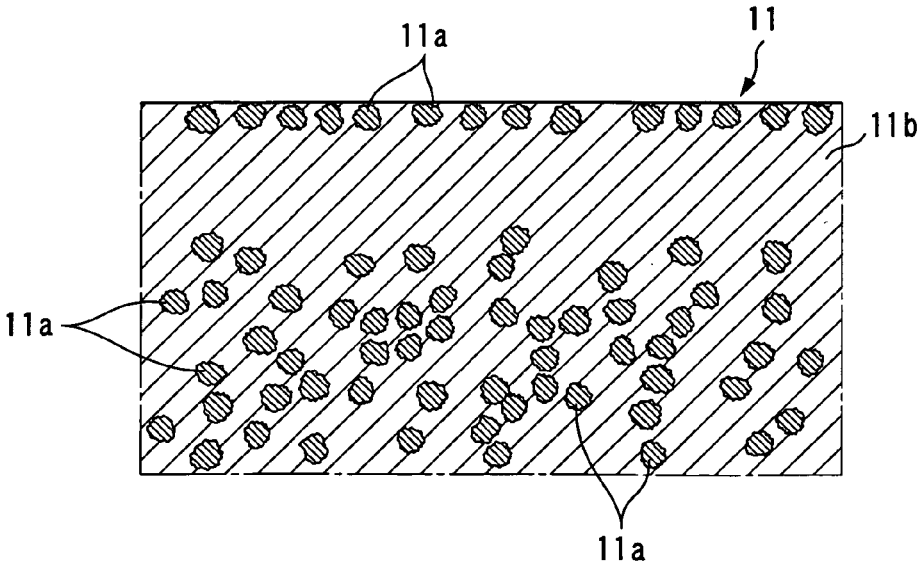

On the other hand, the key touch member 11, which has an L-shaped profile, comprises an integrally formed top cover 11A and a front cover 11B. The top cover 11A has a flat shape similar to the top surface of the key body 10, and is adhered to the top surface of the key body 10 through an adhesive (for example, a vinyl acetate based adhesive). The front cover 11B in turn has a flat shape similar to the front surface of the key body 10, and is attached to the front surface of the key body 10 through an adhesive. Also, as illustrated in FIG. 3, the key touch member 11 comprises a base 11*b* made of an ABS resin as a first synthetic resin, and a large number of hydrophilic polymer particles 11*a* added in the base 11*b* in a dispersed manner.

This hydrophilic polymer 11*a* comprises cross-linked polyacrylamide having a polyoxyethylene chain, the grain diameter of which is on the order of several hundred nanometers, and provides high hydrophilia. The hydrophilic polymer 11*a* is produced through dispersion polymerization using acrylamide, N-methylol acrylamide, 2-hydroxyethyl methacrylate, and acrylic acid as comonomers, using poly(oxyethylene)methacrylate as a dispersion stabilizer, and using hydrophilic organic solvent as a dispersion medium.

Also, the hydrophilic polymer 11*a* is substantially uniformly dispersed in the base 11*b* within the key touch member 11, but unevenly distributed in an area near the surface of the key touch member 11. This is an event which occurs due to the characteristics of the hydrophilic polymer 11*a* when the key touch member 11 is molded while the hydrophilic polymer 11*a* is mixed into a material of ABS resin.

According to the key 1 of this embodiment configured as described above, it was confirmed by an experiment that a water absorption of approximately 4 wt % can be achieved. Specifically, since the key touch member 11 is made of the ABS resin with the hydrophilic polymer 11*a* added thereto, a higher water absorption can be ensured than the conventional key (with a water absorption of 1.5 wt %) made of an acrylate resin with porous particles added thereto, thereby making it possible to ensure higher playing performance. This is attributable to higher water absorption power generally exhibited by the hydrophilic polymer, as compared with the porous particles which physically capture and absorb moisture with pores, because the hydrophilic polymer captures and absorbs moisture with the hydrophilic group thereof. In addition to this, since the key 1 of this embodiment is made such that the hydrophilic polymer 11*a* is unevenly distributed near the surface of the key touch member 11 due to its characteristics, the key 1 can more effectively provide a high water absorption.

Also, since the key body 10 and key touch member 11 are both made of the ABS resin, it is possible to ensure high durability and workability and further ensure an appearance which resembles a key having natural ivory adhered thereto. As a result, a high commercial value can be ensured. Also, since the key touch member 11 can be fabricated as apart separated from the key body 10, a reduced amount of the hydrophilic polymer 11*a* can be added, as compared with the entire key 1 which is fabricated by injection molding of a single type of synthetic resin, and the manufacturing cost can be correspondingly reduced.

Also, when the entire key 1 is made of the ABS resin with the hydrophilic polymer 11*a* added thereto, its dimensions expand or contract due to a water absorbing state of the hydrophilic polymer 11*a* to make it difficult to ensure the dimensional accuracy after the processing, possibly resulting in a lower quality such as noise. In contrast, according to the key 1 of this embodiment, since the key touch member 11 alone need be made of the ABS resin with the hydrophilic polymer 11*a* added thereto, the dimensional accuracy for the processed key body 10, i.e., the dimensional accuracy of the entire key 1 can be ensured at a level substantially equal to that which is presented when the entire key 1 is made of an ABS resin without the hydrophilic polymer 11*a* added thereto, thus making it possible to avoid a lower quality.

While the embodiment has shown an example which employs cross-linked polyacrylamide having a polyoxyethylene chain as the hydrophilic polymer, the hydrophilic polymer is not limited to this, but any polymer may be used instead as long as it has a hydrophilic group in a main chain or a side chain. For example, polyvinyl alcohol/polyacrylic acid based polymer may be used as the hydrophilic polymer.

Also, while the embodiment has shown an example in which the present invention is applied to a key of an electronic piano, it goes without saying that the key of the present invention is not so limited, but can be applied to a variety of keyboard-based musical instruments such as an acoustic piano.

Further, while the embodiment has shown an example of the key touch member 11 which has the base 11*b* and key body 10 made of an ABS resin, they may be made of an acrylonitrile-styrene resin or an acrylic resin. When doing so, the key touch member 11 can ensure high durability and workability as well as an appearance which resembles a key with natural ivory adhered thereto, as is the case with that made of the ABS resin. Further, the base 11*b* and key body 10 of the key touch member 11 may be made of different materials from each other from among ABS resins, acrylonitrile-styrene resins, and acrylic resins.

On the other hand, the key body 10 may be made of a wood material. When doing so, the key 1 can be applied to an acoustic piano.

Also, while the embodiment has shown an example in which the key touch member 11 and key body 10 are separate parts, the key 1 may be fabricated by integrally molding them. In this event, a hydrophilic polymer may be added to the key touch member 11 alone or to the entire key 1. When doing so, the number of manufacturing steps can be reduced as compared with the key touch member 11 and key body 10 which are fabricated as separate parts, so that a time required to fabricate the key 1 can be correspondingly reduced.

INDUSTRIAL AVAILABILITY

As described above, the key for keyboard-based musical instruments according to the present invention allows a finger tip to touch the key with less susceptibility to slippage, while it is made of a synthetic resin, and is therefore useful as a key having high playing performance.

The invention claimed is:

1. A key for a keyboard-based musical instrument characterized by comprising:

a key body; and a key touch member disposed on the top of said key body, made of a first synthetic resin having a large number of hydrophilic polymer particles added thereto in a dispersed manner, and for touching the key;

wherein the hydrophilic polymer particles have a hydrophilic group in a main chain or a side chain thereof, and are substantially uniformly dispersed in a base within said key touch member and unevenly distributed in an area near a surface of said key touch member, wherein said substantially uniform dispersal in the base is different from said uneven distribution in said area near said surface of said key touch member.

2. A key for a keyboard-based musical instrument according to claim 1, characterized in that said first synthetic resin is one of an acrylonitrile butadyenne styrene resin, an acrylonitrile-styrene resin, and an acrylic resin.

3. A key for a keyboard-based musical instrument according to claim 1 or 2, characterized in that said key body is made of one of a second synthetic resin without the hydrophilic polymer particles added thereto, and a wood material, and said key touch member is adhered to said key body.

4. A key for a keyboard-based musical instrument according to claim 1 or 2, characterized in that said key body is made of one of said first synthetic resin having the hydrophilic polymer particles added thereto and a second synthetic resin without the hydrophilic polymer particles added thereto, and is integrally molded with said key touch member.

* * * * *